US007568692B2

(12) United States Patent
Miyake

(10) Patent No.: US 7,568,692 B2
(45) Date of Patent: Aug. 4, 2009

(54) SHEET FEEDER AND IMAGE FORMING APPARATUS USING THE SAME

(75) Inventor: Yasuhiro Miyake, Osaka (JP)

(73) Assignee: Kyocera Mita Corporation (JP)

( * ) Notice: Subject to any disclaimer, the term of this patent is extended or adjusted under 35 U.S.C. 154(b) by 62 days.

(21) Appl. No.: 11/436,156

(22) Filed: May 17, 2006

(65) Prior Publication Data

US 2006/0261538 A1 Nov. 23, 2006

(30) Foreign Application Priority Data

May 23, 2005 (JP) ..... 2005-149579

(51) Int. Cl.
*B65H 1/08* (2006.01)

(52) U.S. Cl. ..... 271/126

(58) Field of Classification Search ..... 271/126, 271/155, 156

See application file for complete search history.

(56) References Cited

U.S. PATENT DOCUMENTS 4,332,375 A * 6/1982 Tsubo ..... 271/9.05
5,100,122 A * 3/1992 Noda et al. ..... 271/155
5,480,131 A * 1/1996 Furukawa et al. ..... 271/9.06
5,641,154 A * 6/1997 Gysling et al. ..... 271/9.01
2005/0087921 A1* 4/2005 Aoki et al. ..... 271/126

FOREIGN PATENT DOCUMENTS

JP 7-144771 6/1995

* cited by examiner

*Primary Examiner*—Patrick H Mackey
*Assistant Examiner*—Howard Sanders
(74) *Attorney, Agent, or Firm*—Gerald E. Hespos; Anthony J. Casella

(57) ABSTRACT

An object of the present invention is to facilitate the inspection of a driving unit for a lifting mechanism for lifting up sheets stacked in a sheet cassette and the detachment thereof from a main body of an image forming apparatus. In order to accomplish this object, the driving unit is detachably mounted on a main frame at a position near a cassette insertion opening that is an insertion opening for the sheet cassette into a cassette accommodating space.

11 Claims, 6 Drawing Sheets

SHEET FEEDER AND IMAGE FORMING APPARATUS USING THE SAME

BACKGROUND OF THE INVENTION

1. Field of the Invention

The present invention relates to a sheet feeder and an suitable for the sheet feed in an image forming apparatus such as a copier, a printer, a facsimile apparatus or a composite apparatus.

2. Description of the Related Art

A conventional sheet feeder installed in an image forming apparatus such as a printer is known, for example, from Japanese Unexamined Patent Publication No. H07-144771. The image forming apparatus disclosed in this publication includes left and right main frames forming a housing as a main body of the image forming apparatus, wherein a space into which a sheet cassette is detachably insertable is defined inside the two main frames. Sheets stacked in the sheet cassette are lifted up by a lifting mechanism while being kept stacked, and the upper surface of the uppermost one of the sheets is pressed from below against a pickup roller provided in an apparatus main body, thereby setting a sheet feedable state.

Here, the lifting mechanism is provided in the sheet cassette, whereas a driving unit for driving this lifting mechanism is normally mounted in the apparatus main body. An example of a mounting structure for this driving unit is shown in FIG. 6.

In FIG. 6, right and left main frames 523, 524 are arranged while being spaced apart, wherein one main frame 523 is formed with a space used to install the driving unit. This driving unit includes a motor 520 as a driving source for the lifting mechanism, an input gear 513, and an idle gear train 521 for transmitting a driving force outputted from the motor 520 to the input gear 513, and these are mounted on the outer side of a side wall of the main frame 523. The input gear 513 is mounted at such a position as to be engaged with a gear included in the lifting mechanism provided in the sheet cassette when the sheet cassette is mounted in the apparatus main body by being inserted into the space between the two main frames 523, 524.

Guiding grooves 523*a*, 524*a* facing each other are formed in the inner surfaces of bottom parts of both main frames 523, 524. These guiding grooves 523*a*, 524*a* extend in an inserting direction of the sheet cassette, along which direction the sheet cassette is guided. The sheet cassette is inserted into the space defined between the two main frames 523, 524 while being guided by the guiding grooves 523*a*, 524*a*, and is set at a position where the above input gear 513 can be engaged with the specified gear included in the lifting mechanism provided in the sheet cassette. In this state, a driving force outputted from the motor 520 is transmitted to the gear of the lifting mechanism provided in the sheet cassette via the idle gear train 521 and the input gear 513, thereby actuating the lifting mechanism.

This driving unit is mounted on the outer side of the main frame 523 together with other parts. After the driving unit is mounted, external members such as decorative sheets are arranged at the outer sides of the main frames 523, 524 to cover the driving unit in lateral direction, whereby the assembling of the image forming apparatus is completed.

During the assembling or after completing the assembling of the image forming apparatus, there are cases where the above driving unit needs to be inspected, repaired or exchanged upon the confirmation of a defect in an operation test of the image forming apparatus or during the maintenance after the delivery. For such an inspection or the like of the driving unit, it is necessary to detach the above external members and expose the driving unit to the outside of the apparatus. Further, for the repair or exchange of the driving unit, it is necessary to detach the driving unit from the main frame.

However, the external members are generally large and cannot be easily detached or remounted. Thus, if the external members are detached every time an adjustment or the like of the driving unit is made, it leads to a reduction in operation efficiency.

Further, since the driving unit needs to be connected with the lifting mechanism of the sheet cassette inserted into the above cassette accommodating space, it is frequently located at a side more toward the cassette accommodating space than other parts, i.e. at an inner side when viewed from the outside of the image forming apparatus. In such a case, it is not easy to inspect or detach the driving unit even with the external members detached.

SUMMARY OF THE INVENTION

In order to solve the above problems, an object of the present invention is to facilitate the inspection of a driving unit of a lifting mechanism for lifting up sheets stacked in a sheet cassette and the detachment thereof from a main body of an image forming apparatus.

In the present invention, the driving unit is mounted on a main frame at a position near a cassette insertion opening through which the sheet cassette is inserted into a cassette accommodating space.

According to the present invention, even if the external members and the like of the image forming apparatus are not detached, it can be made possible, by detaching the sheet cassette from the cassette accommodating space, to visually inspect the driving unit through the cassette insertion opening and to repair or exchange the driving unit by detaching the driving unit through the cassette insertion opening.

DETAILED DESCRIPTION OF THE PREFERRED EMBODIMENTS

Figure 1:
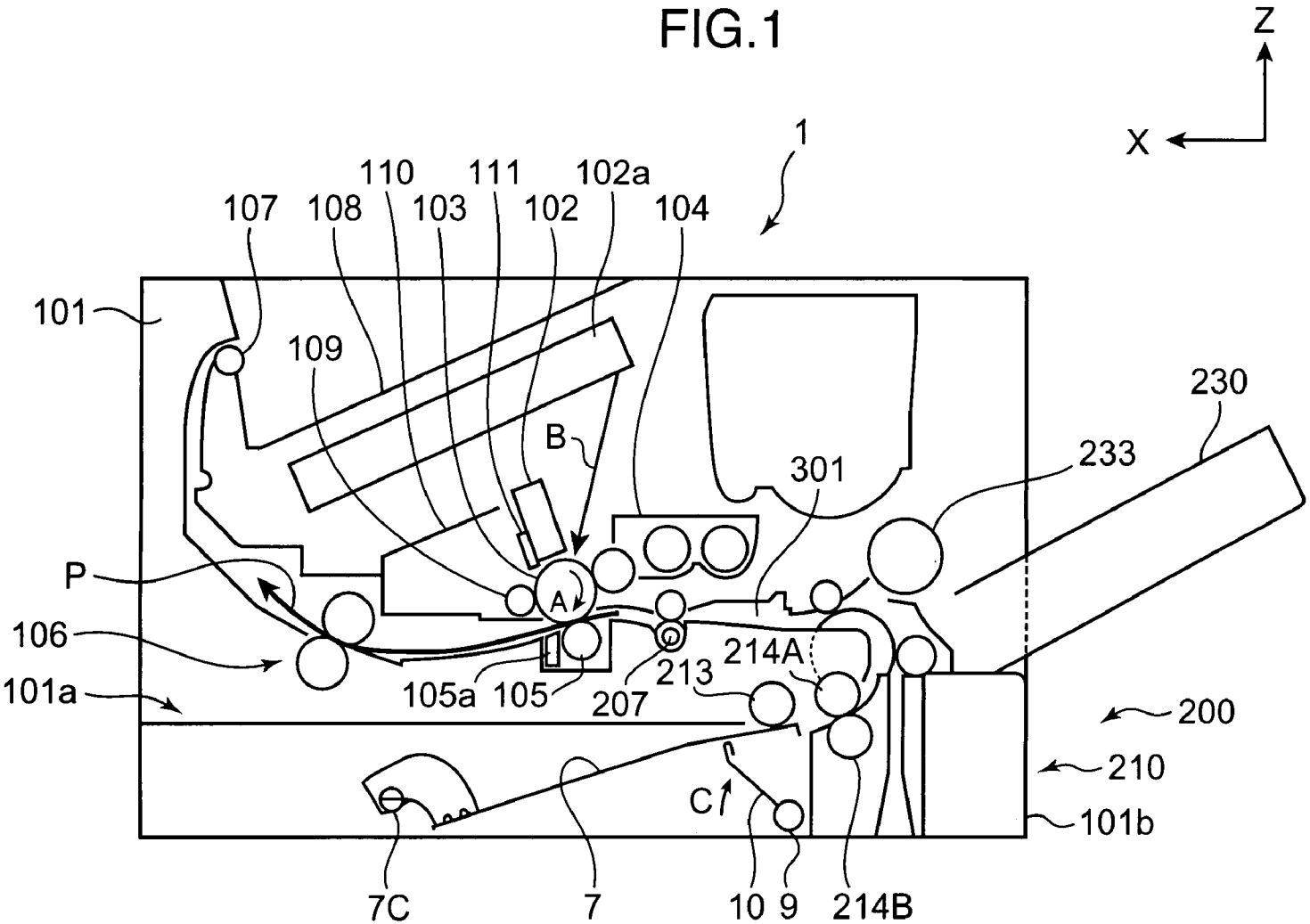
FIG. 1 is a section showing the schematic construction of a printer according to one embodiment of the invention.
Figure 2:
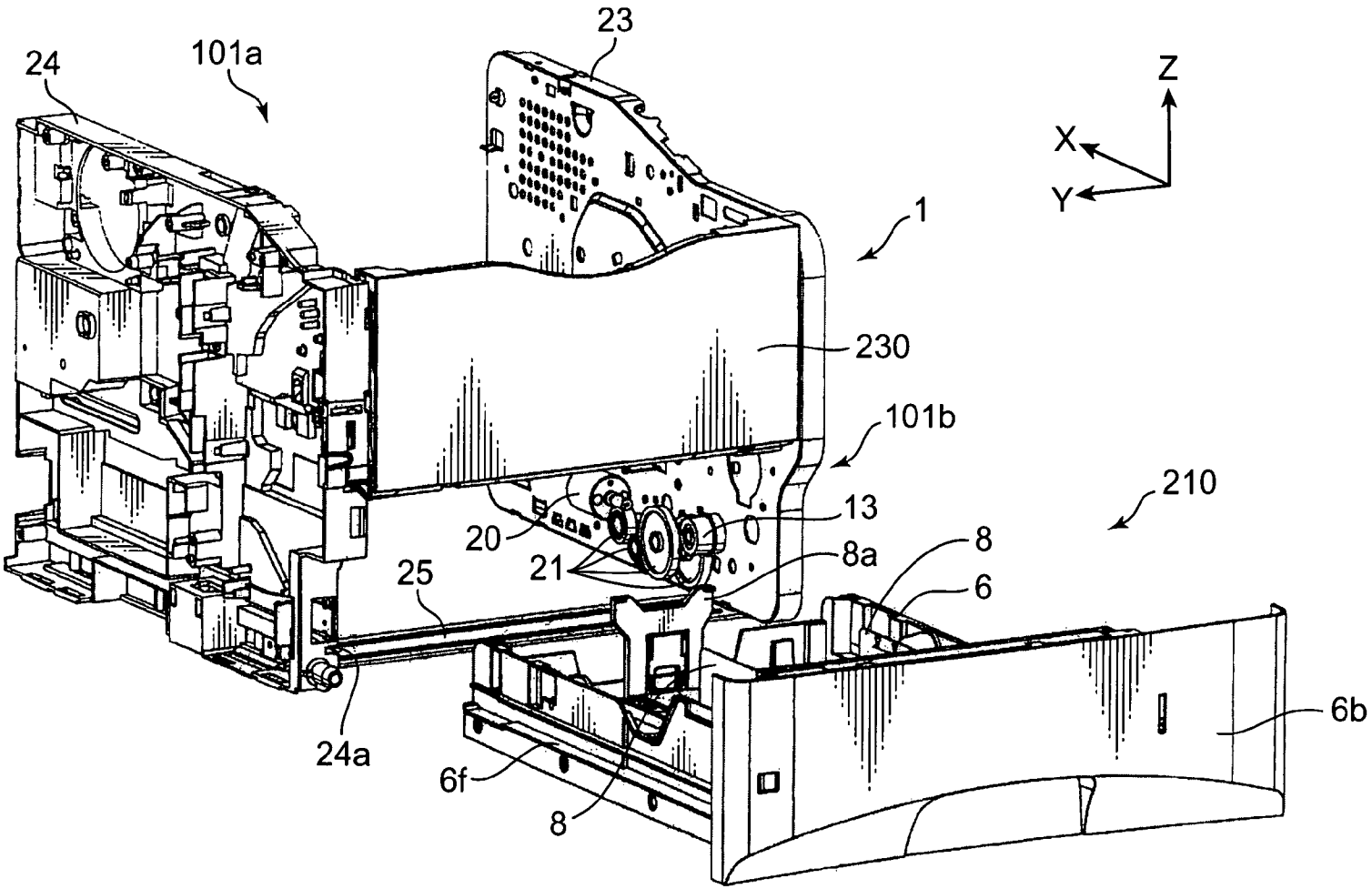
FIG. 2 is a perspective view showing an assembled state of a sheet feeder provided in the printer.

A preferred embodiment of the present invention is described with reference to FIGS. 1 to 5. In this embodiment, a printer 1 is illustrated as an image forming apparatus. In FIGS. 1 and 2, an arrow X indicates an inserting direction of a sheet cassette 210 into a printer main body 101 of the printer 1; an arrow Y indicates a direction from the right side toward the left side of the printer main body 101; an arrow Z indicates a direction from the bottom side toward the top side of the printer main body 101.

FIG. 1 shows the schematic construction of the printer 1. This printer 1 is provided with the printer main body 101 and a sheet feeder 200.

The printer main body 101 is box-shaped, and an image forming unit is provided therein. This image forming unit is for forming an image on a sheet P fed via a conveyance path 301 from the sheet feeder 200, and includes a photosensitive drum 103 driven to rotate in a direction of an arrow A of FIG. 1, a charging device 102, an exposure device 102*a*, a developing device 104, a transfer roller 105, a cleaning device 110, a charge removing device 111, etc. These elements 102 to 111 are arranged around the photosensitive drum 103.

The charging device 102 is for uniformly charging the outer circumferential surface of the photosensitive drum 103. The exposure device 102*a* is comprised of an LSU (laser scanning unit) or the like and is for emitting a laser beam B based on an image data to the outer circumferential surface of the photosensitive drum 103 charged by the charging device 102 to form an electrostatic latent image. The developing device 104 is for supplying toner to the electrostatic latent image to form a toner image on the outer circumferential surface of the photosensitive drum 103. The transfer roller 105 is for transferring the toner image on the outer circumferential surface of the photosensitive drum 103 to the front face of the sheet P conveyed via the conveyance path 301 toward the photosensitive drum 103.

The cleaning device 110 includes a cleaning roller 109, which removes the toner residual on the photosensitive drum 103 after the image transfer. The charge removing device 111 is for removing electric charges residual on the outer circumferential surface of the photosensitive drum 103 having the toner removed therefrom.

A separating device 105*a* is provided in the vicinity of the transfer device 105. This separating device 105*a* is for separating the sheet P after the image transfer from the outer circumferential surface of the photosensitive drum 103. This separated sheet P is conveyed to a pair of fixing rollers 106 and has the toner image fixed thereto by the fixing rollers 106. The sheet P having the image fixed thereto is discharged onto a discharging portion 108 by a discharge roller 107 directly or after being reversed in an unillustrated switch-back portion 108 to have both faces printed.

Next, a specific construction of the sheet feeder 200 is described.

The sheet feeder 200 includes both a sheet cassette 210 for accommodating a plurality of sheets P stacked one over another, and a stack bypass 230 used to manually feed sheet (s).

The sheet cassette 210 is for accommodating a plurality of sheets P stacked one over another, and is detachably inserted into a cassette accommodating space 101*a* formed in the printer main body 101. Specifically, as described in detail later, the cassette accommodating space 101*a* has an opening communicating with the outside of the printer main body 101, and this opening corresponds to a cassette insertion opening 101*b* used to insert the sheet cassette 210 into the cassette accommodating space 101*a*.

The sheet cassette 210 is provided with a pickup roller 213 for dispensing the uppermost one of the sheets P accommodated in the sheet cassette 210, and a pair of feed rollers 214A, 214B for feeding the dispensed sheet P to the conveyance path 301. Out of these rollers, the pickup roller 213 and the upper one 214A of the feed roller pair 214A, 214B are mounted in the printer main body 101, whereas the lower one 214B of the feed roller pair 214A, 214B is mounted in the sheet cassette 210. Similarly, the stack bypass 230 also includes a pickup roller corresponding to the pickup roller 213 and a pair of feed rollers 233 corresponding to the pair of feed rollers 214A, 214B.

Figure 5:
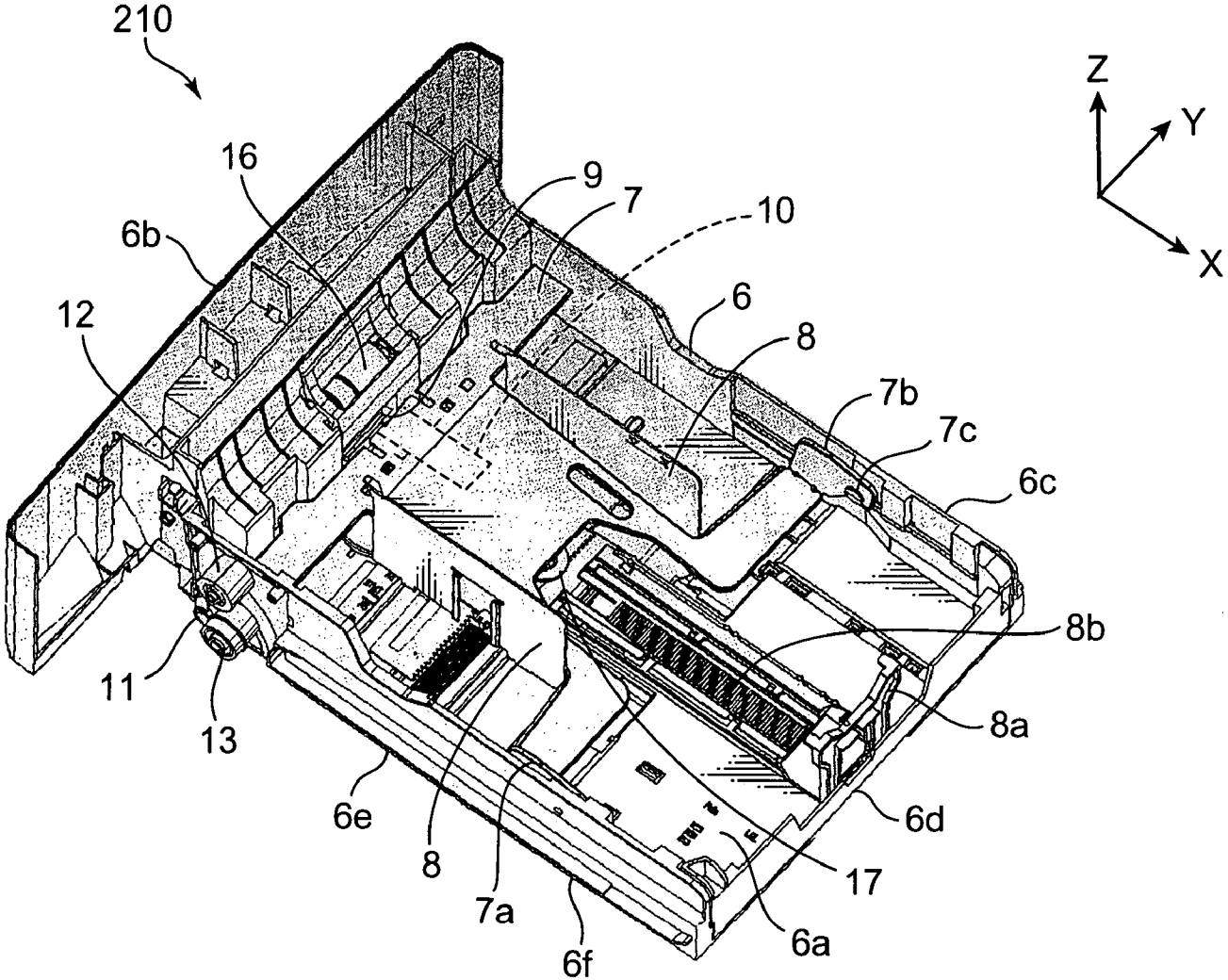
FIG. 5 is a perspective view of a sheet cassette when viewed from above.
Figure 6:
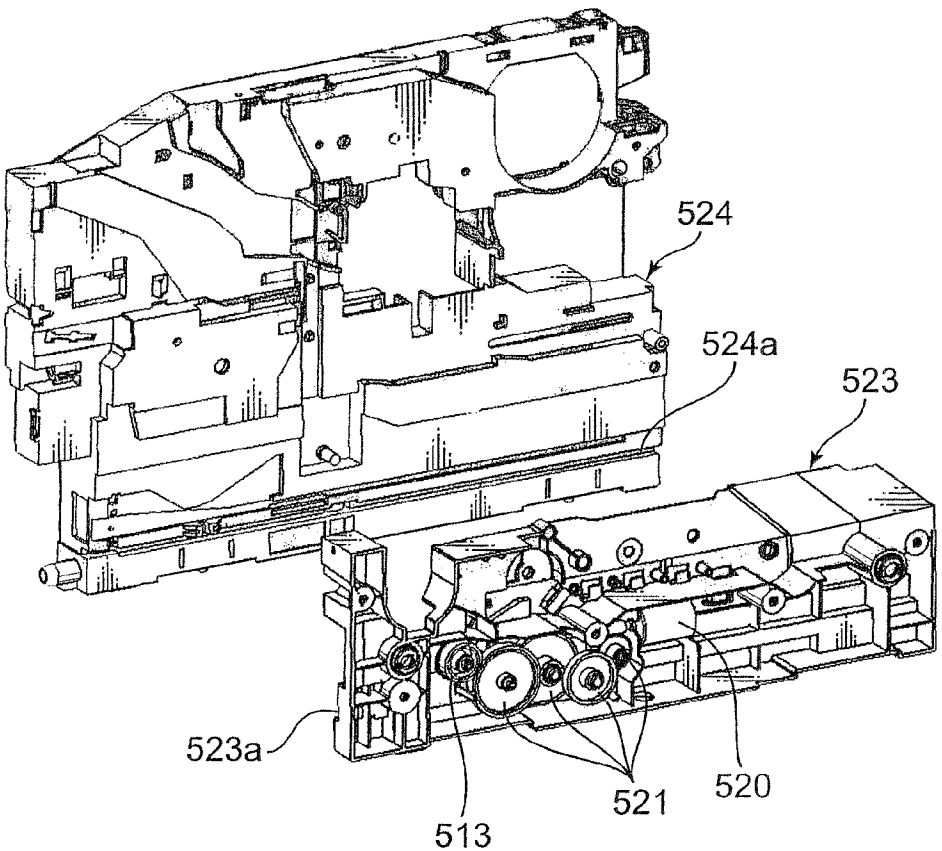
FIG. 6 (PRIOR ART)
FIG. 6 is a perspective view showing the external constructions of left and right main frames provided in a conventional sheet feeder.

An overview of the sheet cassette 210 is shown in FIGS. 2 and 5.

The sheet cassette 210 is provided with a cassette housing 6 having an open upper side, and a lifting mechanism provided in this cassette housing 6.

The cassette housing 6 is comprised of a rectangular bottom plate 6*a*, and a front wall 6*b*, a left wall 6*c*, a rear wall 6*d* and a right wall 6*e* standing up from the four sides of the bottom plate 6*a*. Since the front wall 6*b* has both a function as grip to be gripped upon inserting and detaching the sheet cassette 210 into and from the cassette accommodating space 101*a* and a function as a decorative sheet for closing the cassette insertion opening 101*b*, it has larger height and width than the other walls 6*c* to 6*e*.

As shown in FIGS. 2 and 5, a specific part of each of the left and right walls 6*c*, 6*e* located below a center position with respect to height direction projects outward than the other parts, thereby forming a projecting portion 6*f* (only the left side is shown in FIG. 2 and only the right side is shown in FIG. 5). These projecting portions 6*f* function as sliders to be guided when the sheet cassette 210 is inserted into or detached from the cassette accommodating space 101*a*, and are described in more detail later.

The lifting mechanism includes a lifting plate 7, a rotating member comprised of a shaft 9 and a tongue piece 10, a lifting gear 11 and an idle gear 12.

The lifting plate 7 is a flat plate and is so accommodated in the cassette housing 6 as to cover substantially the front (side near the cassette insertion opening 10*b*) half of the bottom plate 6*a*. A front end (leading end) of the lifting plate 7 is bent slightly downward, and the lifting plate 7 is mounted in the cassette housing 6 such that this front end thereof can be raised relative to the bottom plate 6*a*. Specifically, supportable portions 7*b*, 7*a* stand up from the rear ends of the left and right sides of the lifting plate 7 and are rotatably supported on pins 7*c* provided on the left and right walls 6*c*, 6*e* of the cassette housing 6.

A pair of size restricting plates 8 stand at transversely symmetrical positions on the lifting plate 7. These size restricting plates 8 extend in forward and backward directions to restrict the width of sheets on the lifting plate 7, and are coupled to each other by an interlocking mechanism 17 including a rack and a pinion provided at a lower side of the bottom plate 6*a*.

This interlocking mechanism 17 links the size restricting plates 8 so that the size restricting plates 8 move by the same width in opposite directions along transverse direction. The interlocked movements maintain the symmetry of the two size restricting plates 8 along transverse direction, thereby freeing the position of the sheets P placed on the lifting plate 7 with respect to width direction from the bias.

A rear-end cursor 8*a* for restricting the rear-end positions of the sheets P stand behind the lifting plate 7. This rear-end cursor 8*a* is located in the widthwise center of the cassette housing 6 and is movable in forward and backward directions on a cursor 8*b* extending in forward and backward directions.

The shaft 9 is arranged at a position before the lifting plate 7 on the bottom plate 6*a* of the cassette housing 6. The shaft 9 extends along the transverse direction of the cassette housing 6, and the opposite ends thereof are rotatably supported on the left and right walls 6*c*, 6*e* of the cassette housing 6.

The tongue piece 10 is so fixed at a longitudinal center position of the shaft 9 as to integrally rotate with the shaft 9. This tongue piece 10 extends backward from the shaft 9, and the leading end thereof can be brought into contact with the lower surface of the front part of the lifting plate 7.

The shaft 9 and the tongue piece 10 lift up the front side of the lifting plate 7 held in contact with the leading end of the tongue piece 10 by being rotated in such a direction as to raise the leading end of the tongue piece 10. Conversely, by rotating the shaft 9 and the tongue piece 10 in such a direction as to lower the leading end of the tongue piece 10, the front side of the lifting plate 7 is laid down due to its own weight as the leading end of the tongue piece 10 is lowered.

The shaft 9 penetrates through the right wall 6*e* of the cassette housing 6, a penetrating end of the shaft 9 projects out at the outer side of the right wall 6*e*, and the lifting gear 11 is fixed while being engaged with this end of the shaft 9.

The idle gear 12 is rotatably supported on the right wall 6*e* of the cassette housing 6. This idle gear 12 is set at such a position as to be engaged with the lifting gear 11 and to be engaged with an input gear 13 included in a driving unit to be described later when the sheet cassette 210 is completely inserted into the cassette accommodating space 101*a*. In other words, this idle gear 12 functions as an interlocking gear for interlocking the input gear 13, the lifting gear 11 and the rotating member.

Spur gears made of a synthetic resin are, for example, used as the respective gears described above.

The lower one 214B of the feed roller pair 214A, 214B is mounted in the front wall 6*b* of the cassette housing 6. The lower feed roller 214B comes into contact with the upper roller 214A when the sheet cassette 210 is completely inserted into the cassette accommodating space 101*a* and, at this position, feeds the sheet in cooperation with the upper roller 214A.

Next, the driving unit for driving the above lifting mechanism and a mounting structure therefor are described.

The printer main body 101 includes a right main frame (first main frame) 23 and a left main frame (second main frame) 24 arranged in their upright states as shown in FIG. 2, and bottom parts thereof are located at the opposite sides of the cassette accommodating space 101*a* with respect to transverse direction, i.e. a direction normal to an inserting direction of the sheet cassette 210. The driving unit is provided on the right one 23 of these main frames 23, 24.

Figure 3A:
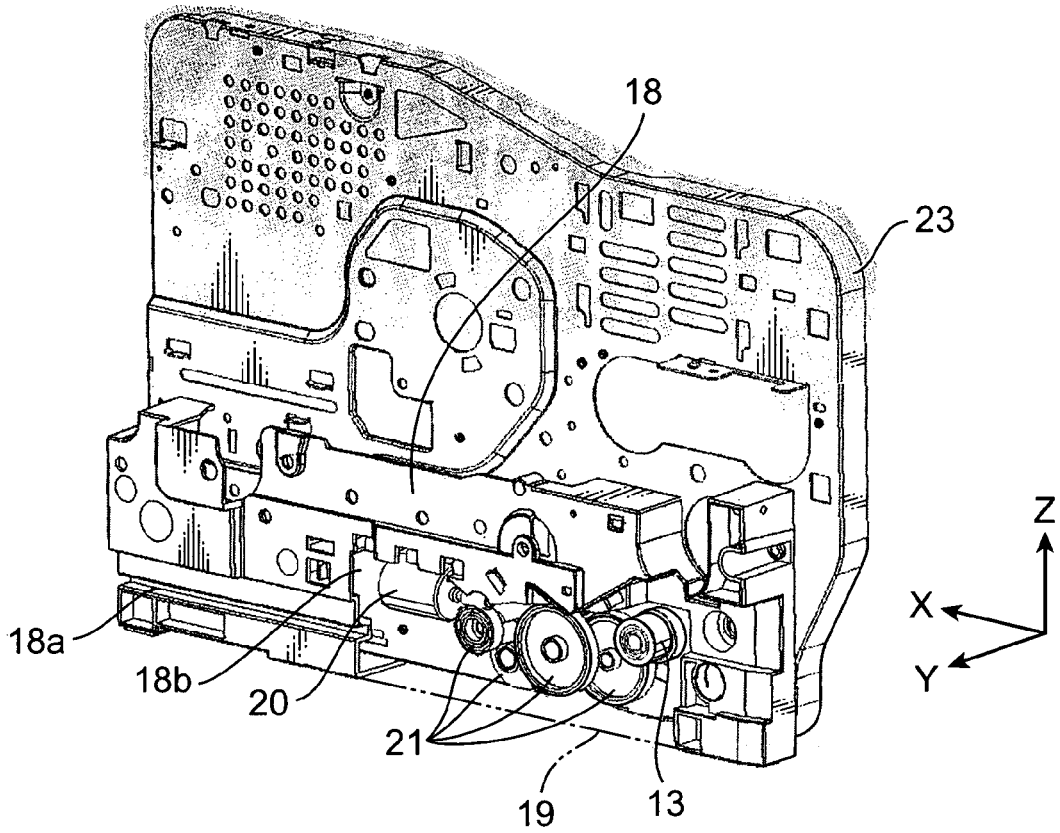
FIG. 3A is a perspective view showing a state where a cover is detached from a right main frame constructing a main body of the printer and FIG. 3B is a diagram showing an arrangement of gears in a driving unit to be mounted on the main frame.
Figure 3B:
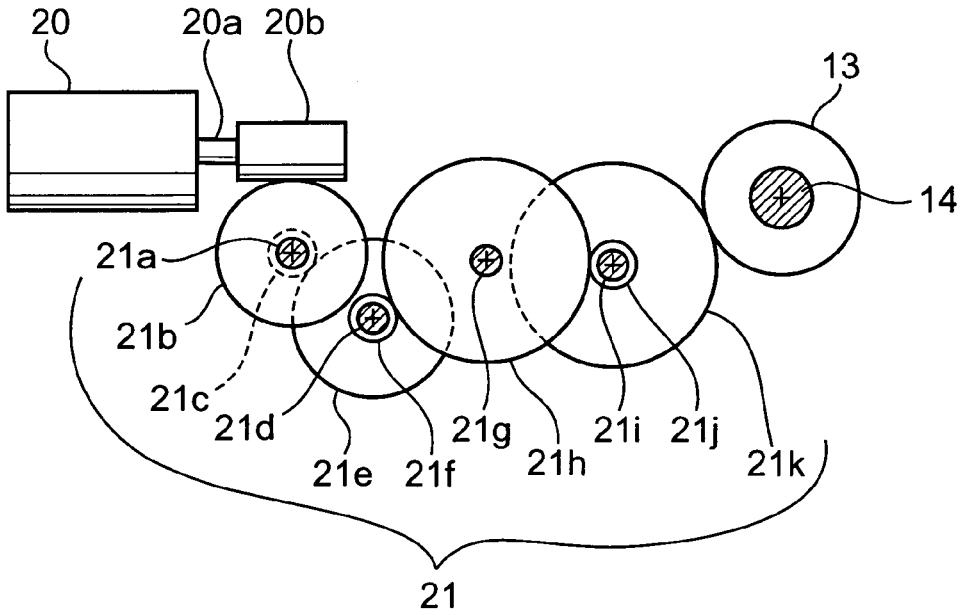

As shown in FIG. 3A, the main frame 23 is substantially in the form of a rectangular flat plate, and the respective elements of the image forming unit and the sheet discharging portion are mounted at suitable positions thereof. The peripheral edge of the main frame 23 is bent outward to enhance the rigidity.

The main frame 23 includes a guide cassette 18 at its bottom side. This guide cassette 18 is fixed to the inner surface of a main plate of the main frame 23, and projects more inward (toward the cassette accommodating space 101*a*) than the other parts of the main frame 23.

A side (right side in FIG. 3A) of the guide cassette 18 close to the cassette insertion opening 101*b* has a lower half thereof cut away, and the above driving unit is arranged in this cut-away portion 18*b*.

The driving unit includes the input gear 13, a motor 20 as a driving source and an idle gear train 21.

The motor 20 is for generating a torque necessary to rotate the rotating member of the lifting mechanism and is, for example, a stepping motor. A worm gear 20*b* is fixed to an output shaft 20*a* of this motor 20, and the idle gear train 21 is provided between the worm gear 20*b* and the input gear 13.

This idle gear train 21 constructs a torque transmitting unit for transmitting the torque of the output shaft 20*a* of the motor 20 to the lifting mechanism of the sheet cassette 210 in cooperation with the worm gear 20*b* and the input gear 13. Specifically, the idle gear train 21 includes a worm wheel 21*b* engaged with the worm gear 20*b*, an intermediate gear 21*c* supported on a shaft 21*a* common to the worm wheel 21*b* so as to be rotatable together with the worm wheel 21*b*, an intermediate gear 21*e* engaged with the intermediate gear 21*c*, an intermediate gear 21*f* supported on a shaft 21*d* common to the intermediate gear 21*e* so as to be rotatable together with the intermediate gear 21*e*, an intermediate gear 21*h* engaged with the intermediate gear 21*f* and supported on a shaft 21*g*, an intermediate gear 21*j* engaged with the intermediate gear 21*h*, and an intermediate gear 21*k* supported on a shaft 21*i* common to the intermediate gear 21*j* so as to be rotatable together with the intermediate gear 21*j*, wherein the input gear 13 is engaged with the intermediate gear 21*k* and supported on a shaft 14.

The respective shafts 21*a*, 21*d*, 21*g*, 21*i* and 14 are supported on the main frame 23 and project inward from this frame 23. The respective intermediate gears 21*b*, 21*c*, 21*e*, 21*f*, 21*h*, 21*j*, 21*k* and the input gear 13 are, for example, spur gears made of a synthetic resin, and are detachably mounted on the respective shafts 21*a*, 21*d*, 21*g*, 21*i* and 14. The above gears are retained on the corresponding shafts, for example, by fitting snap rings into unillustrated grooves formed in the ends of the respective shafts.

Figure 4:
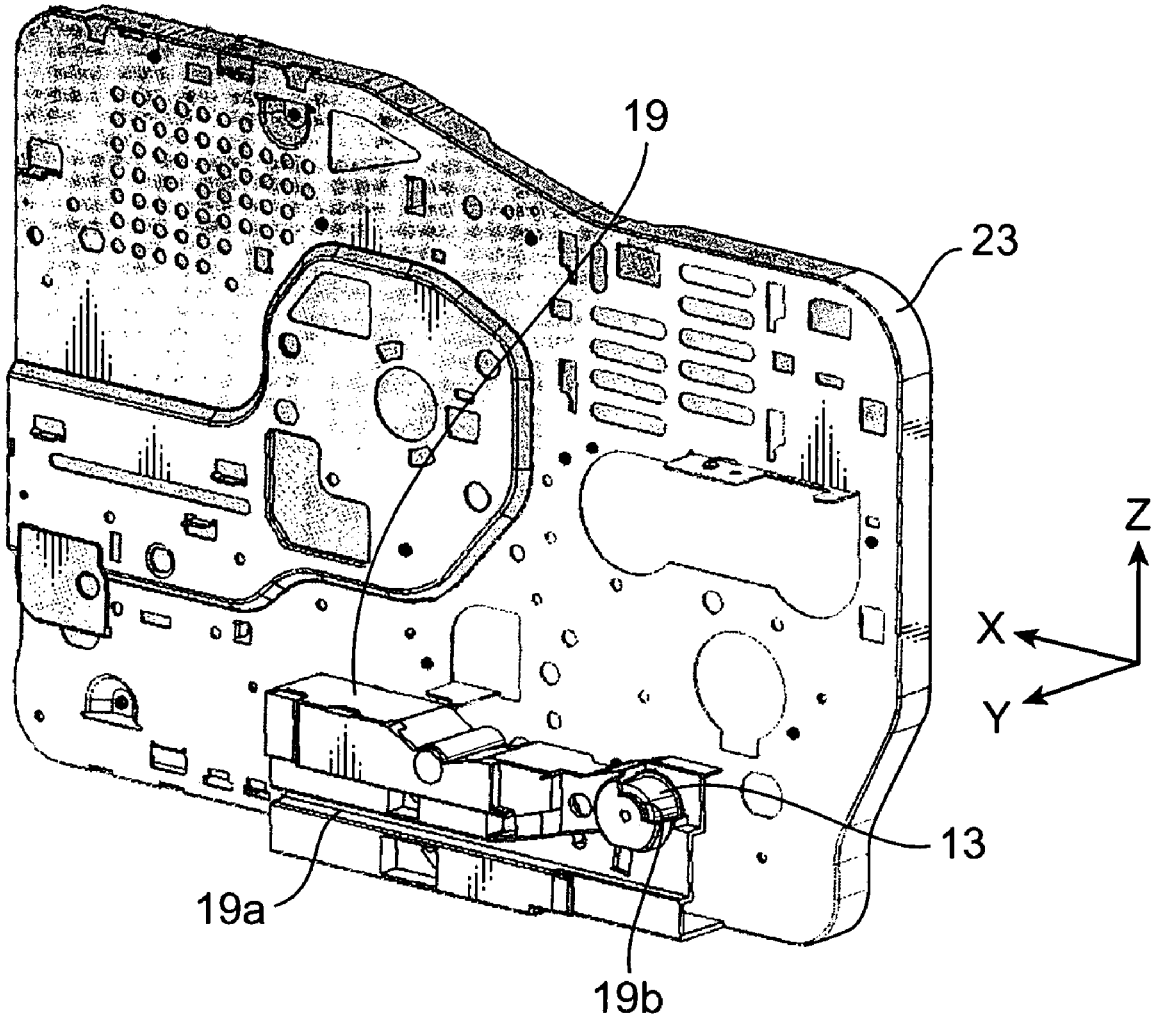
FIG. 4 is a perspective view showing a state where the cover is attached to the main frame.

A cover 19 as shown in FIG. 4 is fitted into the cut-away portion 18*b* of the guide cassette 18. This cover 19 includes unillustrated hooks, which are engaged with unillustrated engaging holes of the guide cassette 18 to detachably attach the cover 19 to the guide cassette 18. In this attached state, the cover 19 covers the driving unit from the side of the cassette accommodating space 101*a*, i.e. from the front side to the plane of FIG. 4.

This cover 19 is formed with a notch 19*b* for locally exposing, only an upper part of the input gear 13 in the above attached state. This upper part of the input gear 13 comes into engagement with the idle gear 12 provided in the sheet cassette 210 when the sheet cassette 210 is completely inserted to a specified set position in the cassette accommodating space 101*a*.

FIG. 3A shows a state where the cover 19 is detached and FIG. 4 conversely shows a state where the cover 19 is attached. The guide cassette 18 is not shown in FIG. 4 for the sake of convenience.

The mount position of the driving unit is set at a position near the cassette insertion opening 101*b*. Specifically, the mount position of the driving unit is set at such a position where, with the sheet feeder 210 detached from the cassette accommodating space 101*a*, the driving unit can be visually confirmed through the cassette insertion opening 101*b* from the outside of the printer 1 and the respective components of the driving unit can be detached and attached through the cassette insertion opening 101*b*.

A lower part of the cover 19 is formed with a guiding groove 19*a* extending in horizontal direction. This cover-side guiding groove 19*a* is formed at such a position where the projecting portion 6*f* formed on the right wall 6*e* of the sheet cassette 210 being inserted into the cassette accommodating space 101*a* is slidably fittable into the guiding groove 19*a* with the cover 19 attached to the main frame 23. By fitting the projecting portion 6*f*, the sheet cassette 210 is guided along the longitudinal direction of the guiding groove 19*a*.

Similarly, the guide cassette 18 is also formed with a horizontally extending guiding groove 18*a* into which the above projecting portion 6*f* is slidably fittable. This frame-side guiding groove 18*a* is formed at such a position as to be continuous with the guiding groove 19*a* when the cover 19 is attached, and has a function of guiding the sheet cassette 210 to the above specified set position in cooperation with the guiding groove 19*a*.

Similarly, the left main frame 24 is also formed with a guiding groove 24*a* as shown in FIG. 2. The projecting portion 6*f* formed on the left side wall 6*c* of the sheet cassette 210 is slidably fitted into this guiding groove 24*a*.

As shown in FIG. 2, the main frames 23, 24 stand opposite to each other and have the bottom ends thereof coupled by a coupling member 25. The stack bypass 230 is arranged at a position above the cassette insertion opening 101*b* between these main frames 24, 23. The stack bypass 230 has the bottom end thereof rotatably supported on the main frames 24, 23, and the posture thereof is switched between an accommodating posture where the stack bypass 230 stands upright as shown in FIG. 2 and a posture reached by opening the stack bypass 230 outward relative to the printer 1 to make the stack bypass 230 usable.

External members (decorative sheets) are arranged at the outer left and right sides, the upper side, the front side and the back side of the main frames 24, 23, and mounted on the main frames 24, 23 by means of screws or the like. In this way, the assembling of the printer 1 is completed.

Next, the functions of the completely assembled printer 1 and the sheet feeder 200 provided in the printer 1 are described.

The sheet cassette 210 is inserted into the cassette accommodating space 101*a* through the cassette insertion opening 101*b* with a plurality of sheets P stacked on the lifting plate 7 in its laid-down state. At this time, the right projecting portion 6*f* of the cassette housing 6 of the sheet cassette 210 is inserted into the guiding groove 19*a* of the cover 19 and further the guiding groove 18*a* of the guide cassette 18, whereas the left projecting portion 6*f* of the cassette housing 6 is inserted into the guiding groove 24*a* of the main frame 24. In this way, the sheet cassette 210 is guided in the inserting direction (horizontal direction in the shown example) to be smoothly set at the specified position. At this set position, the idle gear 12 provided in the sheet cassette 210 and the input gear 13 provided on the main frame 23 are engaged with each other.

When an unillustrated start button provided on the printer 1 is pressed, a specified printing operation is started.

In the above sheet feeder 200, the output shaft 20*a* and the worm gear 20*b* of the motor 20 of the above driving unit start rotating, and a resulting torque is transmitted to the input gear 13 via the idle gear train 21. The torque of this input gear 13 is transmitted to the idle gear 12 in the sheet cassette 210 and further to the lifting gear 11 engaged with this idle gear 12, thereby integrally rotating the shaft 9 with the lifting gear 11 to rotate the tongue piece 10 fixed to the shaft 9 in a direction of an arrow C of FIG. 1, i.e. in such a direction as to raise the leading end of the tongue piece 10.

As the tongue piece 10 is rotated, the leading end thereof comes into contact with the lower surface of the front part of the lifting plate 7 to lift up this front side to a raised position. This causes the uppermost one of the sheets P placed on the lifting plate 7 to be pressed against the pickup roller 13 from below. At this point of time, the motor 20 is automatically stopped to maintain a pressed state of the sheet P and the pickup roller 213. Thereafter, the pickup roller 213 is driven to rotate at a specified timing to take the uppermost sheet P out of the sheet cassette 210.

The sheets P taken out by the pickup roller 213 are separated by the pair of feed rollers 214 to be fed one by one to the conveyance path 301 and let to wait on standby at a pair of registration rollers 207 located before the photosensitive drum 103 as shown in FIG. 1. The sheet P in this standby state is fed to between the photosensitive drum 103 and the transfer roller 105 at a specified timing. The sheet P having a toner image transferred thereto by this transfer roller 105 is conveyed to the pair of fixing rollers 106. The sheet P having the toner image fixed thereto by the pair of fixing rollers 106 is discharged onto the discharging portion 108 by the discharge roller 107.

Here, a case is assumed where an adjustment, a repair, an exchange or the like is necessary, for example, for the intermediate gear 21*h* of the idle gear train 21 of the above driving unit. The adjustment may be necessary at the time of assembling the printer 1 or immediately after the assembling. The repair and the exchange may be necessary at the time of the maintenance of the printer 1.

In the above case, the driving of the printer 1 is forcibly stopped at first. As this operation is performed, an automatic control is executed in the printer 1 to rotate the motor 20 in reverse direction. By this reverse rotation of the motor 20, the tongue piece 10 is rotated in a direction opposite to the above one, i.e. in such a direction as to lower the leading end of the tongue piece 10, followed by a movement of the lifting plate 7 to the laid-down state due to its own weight. At a point of time when the lifting plate 7 is sufficiently laid down, the driving of the motor 20 is automatically stopped to maintain this laid-down state.

Thereafter, the sheet cassette 210 is manually pulled forward out of the cassette accommodating space 101*a*. At this time, the right and left projecting portions 6*f* of the cassette housing 6 of the sheet cassette 210 are respectively guided by the guiding groove 18*a* of the guide cassette 18 and the guiding groove 19*a* of the cover 19*a*, and the guiding groove 24*a* of the main frame 24, wherefore the sheet cassette 210 can be smoothly pulled out.

When the sheet cassette 210 is completely pulled out, the guide cassette 18 and the cover 19 facing the cassette accommodating space 101*a* can be visually confirmed from the outside of the printer 1 through the cassette insertion opening 101*b*. In this state, an operator inserts his hand or the like through the cassette insertion opening 101*b* to pull the cover 19 leftward, whereby the hooks provided on the cover 19 are disengaged from the engaging holes of the guide cassette 18 to enable the detachment of the cover 19. When the cover 19 is detached, the motor 20, the idle gear train 21 and the input gear 13 constructing the driving unit are exposed in the cassette accommodating space 101*a*.

In this state, the intermediate gear 21*h* can be detached from the shaft 21*g* through the cassette insertion opening 101*b* by loosening the snap ring mounted on the shaft 21*g* in the idle gear train 21. This detached intermediate gear 21*h* is easily adjusted or repaired outside the printer 1. This adjusted or repaired intermediate gear 21*h* is mounted on the shaft 21*g* again through the cassette insertion opening 101*b*, and the snap ring is fitted on this shaft 21*g*. Thereafter, the cover 19 detached before is set at a previous position on the guide cassette 18, and the hooks thereof are engaged with the engaging holes to recover the printer 1 to a previous state.

According to the printer 1 of this embodiment, the driving unit for giving the sheets-lifting force to the lifting mechanism provided in the sheet cassette 210 is detachably mounted on the inner side of the main frame 23 at the position near the cassette insertion opening 101*b*. Thus, only by detaching the sheet cassette 210 without detaching the external members and the like of the printer 1, the driving unit can be visually confirmed through the cassette insertion opening 101*b* and can be inspected.

If the driving unit is located at such a position where at least some of components thereof (e.g. the input gear 13) can be visually confirmed through the cassette insertion opening 101*b*, this component can be inspected from the outside. It is) more preferable to locate the driving unit at such a position where all the components thereof can be visually confirmed.

Further, if not only the visual confirmation, but also the detachment of some or all the components of the driving unit from the cassette accommodating space 101*a* through the cassette insertion opening 101*b* is enabled, the driving unit can be easily repaired and exchanged.

Specifically, even if an adjustment or the like is necessary for the driving unit during the assembling of the printer 1 or after the external members and the like are mounted following the assembling, it is possible to detach only the driving unit and make the adjustment or the like therefor without detaching the external members and the like every time as before. Therefore, assembling efficiency and maintenance efficiency can be remarkably improved.

Besides, the present invention may be, for example, embodied as follows.

Although the lifting mechanism in the sheet cassette 210 according to the foregoing embodiment is such as to raise the front part of the lifting plate 7 by rotating the tongue piece 10 held in contact with the lower surface of this front side, the means for raising the lifting plate 7 is not specifically limited according to the present invention. For example, means for raising the lifting plate 7, for example, using a spring or a cam is also embraced by the present invention.

The construction of the driving unit for the lifting mechanism is not specifically limited according to the present invention, either. For example, a belt transmitting mechanism including a belt and the like may be used in place of the idle gear train 21 according to the foregoing embodiment. In such a case as well, the above belt and the like can be easily adjusted, repaired and exchanged according to the present invention.

Although the main frame is divided into the right main frame 23 and the left main frame 24 in the foregoing embodiment, the entire main frame may be an integral unit according to the present invention. Further, although the driving unit is provided on the right main frame 23 in the foregoing embodiment, it may be provided on the left main frame 24.

Although the cassette insertion opening 101*b* is defined at the front side (right side in FIG. 1) of the printer 1 in the foregoing embodiment, the cassette insertion opening 101*b* may be defined at the back side (left side in FIG. 1) of the printer 1 depending on the type of the printer 1. In such a case as well, the driving unit is arranged at a position near the cassette insertion opening 101*b* according to the present invention.

The sheet feeder according to the present invention is not limited to the one provided with only one sheet cassette. For example, a sheet feeder including a plurality of sheet cassettes detachably insertable into the main frame, wherein lifting mechanism(s) and driving unit(s) for at least some of these sheet cassettes satisfy the above requirements, is embraced by the present invention.

Whether or not the cover 19 is provided is optional according to the present invention. However, the driving unit can be effectively protected by providing this cover 19. If the cover 19 is detachably attachable through the cassette insertion opening 101*b* with the sheet cassette 210 detached from the cassette accommodating space 101*a*, the driving unit can be inspected and repaired through the cassette insertion opening 101*b* by detaching the cover 19. Further, if the cover 19 is provided with at least part of the guiding portion for guiding the sheet cassette 210 in the inserting direction as shown, the guiding portion of the sheet cassette 210 can be constructed utilizing the cover 19 even if an area of the main frame 23 facing the cassette accommodating space 101*a* is limited.

The image forming apparatus according to the present invention is not limited to the above printer 1. The present invention is also applicable to other image forming apparatuses such as copiers, facsimile apparatuses and composite apparatuses.

This application is based on patent application No. 2005-149579 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. A sheet feeder provided in an image forming apparatus, the image forming apparatus including at least one main frame mounted by screws in the image forming apparatus and defining a cassette accommodating space, the cassette accommodating space having a cassette insertion opening that opens to areas outside the image forming apparatus, the sheet feeder comprising:

a sheet cassette in which sheets used for image formation are stacked, the sheet cassette being detachably insertable through the cassette insertion opening and into the cassette accommodating space along an inserting direction of the sheet cassette, a lifting mechanism mounted to the sheet cassette for movement with the sheet cassette relative to the main frame, the lifting mechanism being configured to receive a driving force from a location external of the sheet cassette for lifting the sheets stacked in the sheet cassette inserted into the cassette accommodating space up to a sheet feedable position, and a driving unit mounted on the main frame at a position for permitting insertion and removal of the sheet cassette into and out of the cassette accommodating space independent of the driving unit, the driving unit including a driving source and at least one gear driven by the driving source for giving a power to the lifting mechanism for lifting up the sheets by the lifting mechanism, wherein the driving source and the at least one gear of the driving unit are mounted on an inner part of the main frame facing the cassette accommodating space at such a position near the cassette insertion opening so that the at least one gear of the driving unit can be detached to the outside of the image forming apparatus through the cassette insertion opening with the sheet cassette detached from the cassette accommodating space, and wherein the driving source and the at least one gear of the driving unit are mounted at a position to be visually confirmed from outside of the image forming apparatus through the cassette insertion opening with the sheet cassette detached from the cassette accommodating space.

2. A sheet feeder according to claim 1, wherein the entire driving unit is mounted on an inner part of the main frame facing the cassette accommodating space at such a position where the entire driving unit can be visually confirmed from the outside of the image forming apparatus through the cassette insertion opening with the sheet cassette detached from the cassette accommodating space.

3. A sheet feeder provided in an image forming apparatus, the image forming apparatus including at least one main frame mounted by screws in the image forming apparatus and defining a cassette accommodating space, the cassette accommodating space having a cassette insertion opening that opens to areas outside the image forming apparatus, the sheet feeder comprising:

a sheet cassette in which sheets used for image formation are stacked, the sheet cassette being detachably insertable through the cassette insertion opening and into the cassette accommodating space along an inserting direction of the sheet cassette, a lifting mechanism mounted to the sheet cassette for movement with the sheet cassette relative to the main frame, the lifting mechanism being configured to receive a driving force from a location external of the sheet cassette for lifting the sheets stacked in the sheet cassette inserted into the cassette accommodating space up to a sheet feedable position, and a driving unit mounted on the main frame at a position for permitting insertion and removal of the sheet cassette into and out of the cassette accommodating space independent of the driving unit, the driving unit including a driving source and at least one gear driven by the driving source for giving a power to the lifting mechanism for lifting up the sheets by the lifting mechanism, wherein the driving source and the at least one gear of the driving unit are mounted on an inner part of the main frame facing the cassette accommodating space at such a position near the cassette insertion opening so that the at least one gear of the driving unit can be detached to the outside of the image forming apparatus through the cassette insertion opening with the sheet cassette detached from the cassette accommodating space, and wherein the entire driving unit is mounted at such a position where the entire driving unit can be detached to the outside of the image forming apparatus through the cassette insertion opening with the sheet cassette detached from the cassette accommodating space.

4. A sheet feeder provided in an image forming apparatus, the image forming apparatus including at least one main frame mounted by screws in the image forming apparatus and defining a cassette accommodating space, the cassette accommodating space having a cassette insertion opening that opens to areas outside the image forming apparatus, the sheet feeder comprising:

a sheet cassette in which sheets used for image formation are stacked, the sheet cassette being detachably insertable through the cassette insertion opening and into the cassette accommodating space along an inserting direction of the sheet cassette, a lifting mechanism mounted to the sheet cassette for movement with the sheet cassette relative to the main frame, the lifting mechanism being configured to receive a driving force from a location external of the sheet cassette for lifting the sheets stacked in the sheet cassette inserted into the cassette accommodating space up to a sheet feedable position, and a driving unit mounted on the main frame at a position for permitting insertion and removal of the sheet cassette into and out of the cassette accommodating space independent of the driving unit, the driving unit including a driving source and at least one gear driven by the driving source for giving a power to the lifting mechanism for lifting up the sheets by the lifting mechanism, wherein the driving source and the at least one gear of the driving unit are mounted on an inner part of the main frame facing the cassette accommodating space at such a position near the cassette insertion opening so that the at east one gear of the driving unit can be detached to the outside of the image forming apparatus through the cassette insertion opening with the sheet cassette detached from the cassette accommodating space, and wherein the driving unit includes a power transmitting unit for transmitting the power generated by the driving source to the lifting mechanism, the power transmitting unit including the at least one gear.

5. A sheet feeder provided in an image forming apparatus, the image forming apparatus including at least one main frame mounted by screws in the image forming apparatus and defining a cassette accommodating space, the cassette accommodating space having a cassette insertion opening that opens to areas outside the image forming apparatus, the sheet feeder comprising:

a sheet cassette in which sheets used for image formation are stacked, the sheet cassette being detachably insertable through the cassette insertion opening and into the cassette accommodating space along an inserting direction of the sheet cassette, a lifting mechanism mounted to the sheet cassette for movement with the sheet cassette relative to the main frame, the lifting mechanism being configured to receive a driving force from a location external of the sheet cassette for lifting the sheets stacked in the sheet cassette inserted into the cassette accommodating space up to a sheet feedable position, and a driving unit mounted on the main frame at a position for permitting insertion and removal of the sheet cassette into and out of the cassette accommodating space independent of the driving unit, the driving unit including a driving source and at least one gear driven by the driving source for giving a power to the lifting mechanism for lifting up the sheets by the lifting mechanism, wherein the driving source and the at least one gear of the driving unit are mounted on an inner part of the main frame facing the cassette accommodating space at such a position near the cassette insertion opening so that the at least one gear of the driving unit can be detached to the outside of the image forming apparatus through the cassette insertion opening with the sheet cassette detached from the cassette accommodating space, and wherein the lifting mechanism lifts up parts of the sheets stacked in the sheet cassette at a side near the cassette insertion opening.

6. A sheet feeder according to claim 5, wherein:

the lifting mechanism includes a lifting plate mounted in the sheet cassette such that the lifting plate can be raised and laid down and having the sheets placed on an upper surface thereof, the rotatable member being held in contact with a lower surface of a portion of the lifting plate at the side near the cassette insertion opening and being rotatable to raise the portion of the lifting plate held in contact, and an interlocking gear rotatable in conjunction with the rotation of the rotatable member, and the at least one gear of the driving unit includes an input gear that comes into engagement with the interlocking gear to transmit the power generated by the driving source to the interlocking gear when the sheet cassette is inserted into the cassette accommodating space.

7. A sheet feeder provided in an image forming apparatus, the image forming apparatus including at least one main frame mounted by screws in the image forming apparatus and defining a cassette accommodating space, the cassette accommodating space having a cassette insertion opening that opens to areas outside the image forming apparatus, the sheet feeder comprising:

a sheet cassette in which sheets used for image formation are stacked, the sheet cassette being detachably insertable through the cassette insertion opening and into the cassette accommodating space along an inserting direction of the sheet cassette, a lifting mechanism mounted to the sheet cassette for movement with the sheet cassette relative to the main frame, the lifting mechanism being configured to receive a driving force from a location external of the sheet cassette for lifting the sheets stacked in the sheet cassette inserted into the cassette accommodating space up to a sheet feedable position, and a driving unit mounted on the main frame at a position for permitting insertion and removal of the sheet cassette into and out of the cassette accommodating space independent of the driving unit, the driving unit including a driving source and at least one gear driven by the driving source for giving a power to the lifting mechanism for lifting up the sheets by the lifting mechanism, wherein the driving source and the at least one gear of the driving unit are mounted on an inner part of the main frame facing the cassette accommodating space at such a position near the cassette insertion opening so that the at least one gear of the driving unit can be detached to the outside of the image forming apparatus through the cassette insertion opening with the sheet cassette detached from the cassette accommodating space, and wherein the at least one main frame includes a first main frame arranged at one side of the cassette accommodating space and a second main frame arranged at the opposite side, and the driving unit is provided on a side surface of at least one of the first and second main frames, the side surface facing the cassette accommodating space.

8. A sheet feeder provided in an image forming apparatus, the image forming apparatus including at least one main frame mounted by screws in the image forming apparatus and defining a cassette accommodating space, the cassette accommodating space having a cassette insertion opening that opens to areas outside the image forming apparatus, the sheet feeder comprising:

a sheet cassette in which sheets used for image formation are stacked, the sheet cassette being detachably insertable through the cassette insertion opening and into the cassette accommodating space along an inserting direction of the sheet cassette, a lifting mechanism mounted to the sheet cassette for movement with the sheet cassette relative to the main frame, the lifting mechanism being configured to receive a driving force from a location external of the sheet cassette for lifting the sheets stacked in the sheet cassette inserted into the cassette accommodating space up to a sheet feedable position, and a driving unit mounted on the main frame at a position for permitting insertion and removal of the sheet cassette into and out of the cassette accommodating space independent of the driving unit, the driving unit including a driving source and at least one gear driven by the driving source for giving a power to the lifting mechanism for lifting up the sheets by the lifting mechanism, wherein the driving source and the at least one gear of the driving unit are mounted on an inner part of the main frame facing the cassette accommodating space at such a position near the cassette insertion opening so that the at least one gear of the driving unit can be detached to the outside of the image forming apparatus through the cassette insertion opening with the sheet cassette detached from the cassette accommodating space, and further comprising a cover detachably attachable to the main frame at a position in the cassette accommodating space, wherein the cover covers parts of the driving unit except an engaged part which is adapted to be engaged with the lifting mechanism from the side of the cassette accommodating space with the cover attached to the main frame, and at least the engaged part of the driving unit can be visually confirmed from the outside of the image forming apparatus through the cassette insertion opening with the cover detached from the main frame and with the sheet cassette detached from the cassette accommodating space.

9. A sheet feeder provided in an image forming apparatus, comprising:

a sheet cassette in which sheets used for image formation are stacked, a main frame defining opposite sides of a cassette accommodating space, into which the sheet cassette is detachably insertable, the opposite sides being spaced apart in a direction normal to an inserting direction of the sheet cassette, a lifting mechanism for lifting the sheets stacked in the sheet cassette inserted into the cassette accommodating space up to a sheet feedable position, a driving unit mounted on the main frame for giving a power for lifting up the sheets to the lifting mechanism, at least one component of the driving unit being detachably mounted on an inner part of the main frame facing the cassette accommodating space at such a position near a cassette insertion opening that is an insertion opening for the sheet cassette into the cassette accommodating space so that the component of the driving unit can be detached to the outside of the image forming apparatus through the cassette insertion opening with the sheet cassette detached from the cassette accommodating space, and a cover detachably attachable to the main frame and covering parts of the driving unit except an engaged part which is adapted to be engaged with the lifting mechanism from the side of the cassette accommodating space with the cover attached to the main frame, and at least the engaged part of the driving unit can be visually confirmed from the outside of the image forming apparatus through the cassette insertion opening with the cover detached from the main frame and with the sheet cassette detached from the cassette accommodating space, and the cover-side guiding portion guides the sheet cassette in inserting and detaching directions of the sheet cassette in the cassette accommodating space with the cover attached to the main frame.

10. A sheet feeder according to claim 9, wherein the main frame is provided with a frame-side guiding portion for guiding the sheet cassette in the inserting and detaching directions of the sheet cassette in the cassette accommodating space, and the frame-side guiding portion becomes continuous with the cover-side guiding portion when the cover is attached to the main frame.

11. An image forming apparatus, comprising:

a main body;

first and second spaced apart main frames mounted by screws in the main body and defining a cassette accommodating space therebetween, the cassette accommodating space defining a cassette insertion opening that opens to areas outside the image forming apparatus;

a sheet cassette in which sheets used for image formation are stacked, the sheet cassette being detachably insertable through the cassette insertion opening and into the cassette accommodating space along an inserting direction;

an image forming unit mounted in the main body in fixed relation to the main frames for forming an image on sheets fed from the sheet cassette;

a lifting mechanism for lifting the sheets stacked in the sheet cassette inserted into the cassette accommodating space up to a sheet feedable position, the lifting mechanism being mounted to the sheet cassette for movement with the sheet cassette relative to the main frames, the lifting mechanism being configured to receive a driving force from a location external of the sheet cassette, and a driving unit including a driving source and at least one gear mounted on the first main frame at a position for permitting insertion and removal of the sheet cassette into and out of the cassette accommodating space independent of the driving unit, the at least one gear being disposed for giving power to the lifting mechanism for lifting up the sheets when the sheet cassette is in the cassette accommodating space, at least the driving source and the gear of the driving unit being mounted on an inner part of the first main frame facing the cassette accommodating space at a position sufficiently near the cassette insertion opening so that the at least one gear of the driving unit can be detached to the outside of the image forming apparatus through the cassette insertion opening with the sheet cassette detached from the cassette accommodating space, and wherein the driving source and the at least one gear of the driving unit are mounted at a position to be visually confirmed from outside of the image forming apparatus through the cassette insertion opening with the sheet cassette detached from the cassette accommodating space.

* * * * *